US010494140B2

(12) United States Patent
Shuert

(10) Patent No.: US 10,494,140 B2
(45) Date of Patent: Dec. 3, 2019

(54) PALLET STACKER

(71) Applicant: Shuert Technology, LLC, Sterling Heights, MI (US)

(72) Inventor: Lyle H. Shuert, Birmingham, MI (US)

(73) Assignee: Shuert Technology, LLC, Sterling Heights, MI (US)

( * ) Notice: Subject to any disclaimer, the term of this patent is extended or adjusted under 35 U.S.C. 154(b) by 115 days.

(21) Appl. No.: 15/898,811

(22) Filed: Feb. 19, 2018

(65) Prior Publication Data

US 2018/0251259 A1 Sep. 6, 2018

Related U.S. Application Data

(60) Provisional application No. 62/466,467, filed on Mar. 3, 2017.

(51) Int. Cl.

*B65D 19/00* (2006.01)
*B65D 19/18* (2006.01)
*B65D 21/02* (2006.01)

(52) U.S. Cl.

CPC ..... *B65D 19/0018* (2013.01); *B65D 19/18* (2013.01); *B65D 21/0215* (2013.01); *B65D 2519/00034* (2013.01); *B65D 2519/00069* (2013.01); *B65D 2519/0096* (2013.01); *B65D 2519/0098* (2013.01); *B65D 2519/00104* (2013.01); *B65D 2519/00139* (2013.01); *B65D 2519/00174* (2013.01); *B65D 2519/00243* (2013.01); *B65D 2519/00273* (2013.01); *B65D 2519/00567* (2013.01)

(58) Field of Classification Search

CPC .... B65D 19/0018; B65D 19/04; B65D 19/18; B65D 21/0215; B65D 2519/00034; B65D 2519/00069; B65D 2519/2519; B65D 2519/00139; B65D 2519/00174; B65D 2519/00243; B65D 2519/00273; B65D 2519/00567; B65D 2519/0096; B65D 2519/0098

USPC ..... 206/386, 503, 509, 511, 598, 599, 600, 206/821; 108/53.1, 53.3, 53.5, 158.11, 108/158.12

See application file for complete search history.

(56) References Cited

U.S. PATENT DOCUMENTS 2,918,190 A 12/1959 Martin
3,524,415 A * 8/1970 Heiman ..... B65D 19/004 108/53.3
4,287,997 A * 9/1981 Rolfe ..... B65D 19/08 206/504
4,413,737 A * 11/1983 Wind ..... B65D 19/0018 108/53.1
RE32,344 E * 2/1987 Wind ..... B65D 19/0018 108/53.1
4,673,087 A * 6/1987 Webb ..... B65D 11/1873 16/225
5,004,102 A * 4/1991 Timmins ..... B65D 19/06 206/319
5,279,423 A 1/1994 Shuert
(Continued)

*Primary Examiner* — Luan K Bui
(74) *Attorney, Agent, or Firm* — Young Basile Hanlon & MacFarlane, P.C.

(57) ABSTRACT

A molded plastic stacking device is placed between stacked containers of the type having a pallet bottom supporting a container body or sleeve. The device fits onto the top of one container and provides receptacles that receive and stabilize the legs of an upper pallet that is part of another container.

2 Claims, 7 Drawing Sheets

(56) References Cited

U.S. PATENT DOCUMENTS

| | | | | |
|---|---|---|---|---|
| 5,549,056 | A * | 8/1996 | Jordan | B65D 19/0018 108/57.25 |
| D733,426 | S * | 7/2015 | Haas | D3/272 |
| 2011/0132801 | A1* | 6/2011 | Elder | B65D 19/18 206/600 |
| 2019/0177060 | A1* | 6/2019 | Jian | B65D 21/0223 |

* cited by examiner

PALLET STACKER

CROSS-REFERENCE TO RELATED APPLICATIONS

This application is a non-provisional of U.S. Provisional Patent Application No. 62/466,467 filed Mar. 3, 2017, the entire content of which is incorporated herein, and claims priority to it.

TECHNICAL FIELD

This disclosure relates to shipping and storage containers and more particularly to a system and method for stacking containers having a plastic pallet bottom.

BACKGROUND

Plastic pallets may be used in a variety of shipping and storage applications. For example, shipping and storage containers generally include a bottom comprising a plastic pallet and a sleeve adapted to fit onto the plastic pallet. The sleeve may comprise: corrugated, heavy duty paperboard; plastic; other suitable material; or a combination thereof. The typical shape for a shipping and storage container is square or rectangular and the plastic pallet typically has nine feet or legs arranged in rows so as to provide entry points for a forklift on all sides.

SUMMARY OF THE INVENTION

A molded plastic transition component fits between the top of a lower container and the bottom pallet of an upper container stacked on the lower container. The transition component has a frame with integral boots arranged and configured to receive the legs of the bottom pallet of the upper container to prevent lateral sliding movement between the two containers. The transition component can be thermoformed or injection molded.

BRIEF DESCRIPTION OF THE DRAWINGS

The disclosure is best understood from the following detailed description when read in conjunction with the accompanying drawings. It is emphasized that, according to common practice, the various features of the drawings are to-scale. However, the various features of the drawings may include dimensions other than those illustrated and/or described herein.

DETAILED DESCRIPTION

Plastic pallets may be used in a variety of shipping and storage applications. For example, the shipping and storage container described in U.S. Pat. No. 5,279,423 issued to Lyle Shuert on Jan. 18, 1994, includes a bottom comprising a nine-legged plastic pallet and a sleeve adapted to fit onto the plastic pallet. The sleeve may be made of corrugated, heavy duty paperboard; plastic; other suitable material; or a combination thereof. The typical shape for a shipping and storage container is square or rectangular and the plastic pallet typically has the nine feet or legs arranged in rows so as to provide entry points for a forklift on all sides. The shipping and storage container may be used to store various items, such as mail, parcels, bags, garbage, shipping materials, and other items. The forklift fork is inserted into one or more entry points defined by the arrangement of the feet or legs of the pallet. The forklift lifts the shipping and storage container in order to transport the shipping and storage container from a first location to a second location and/or to stack containers on top of one another.

In some embodiments, the container may include a molded plastic top such as that shown in the '423 patent. The top may have a shape corresponding to the shape of the container and may be generally flat. The top operates to close the shipping and storage container. The bottom pallet, sleeve, and top are usually banded together when loaded.

It may be beneficial, in some cases, to stack one or more containers on top of another container to reduce the amount of floor space taken up by the containers.

Without reinforcement, the top of a shipping and storage container may not tolerate the weight of another shipping and storage container. For example, a flat top, as described above, may be susceptible to deformation from one or more of the feet or legs of the plastic pallet associated with the uppermost container. Additionally, in some cases, the shipping and storage container may omit a top (e.g., the sleeve is open on a side opposite the plastic pallet) which may render the shipping and storage container unsuited in supporting another shipping and storage container.

Figure 1:
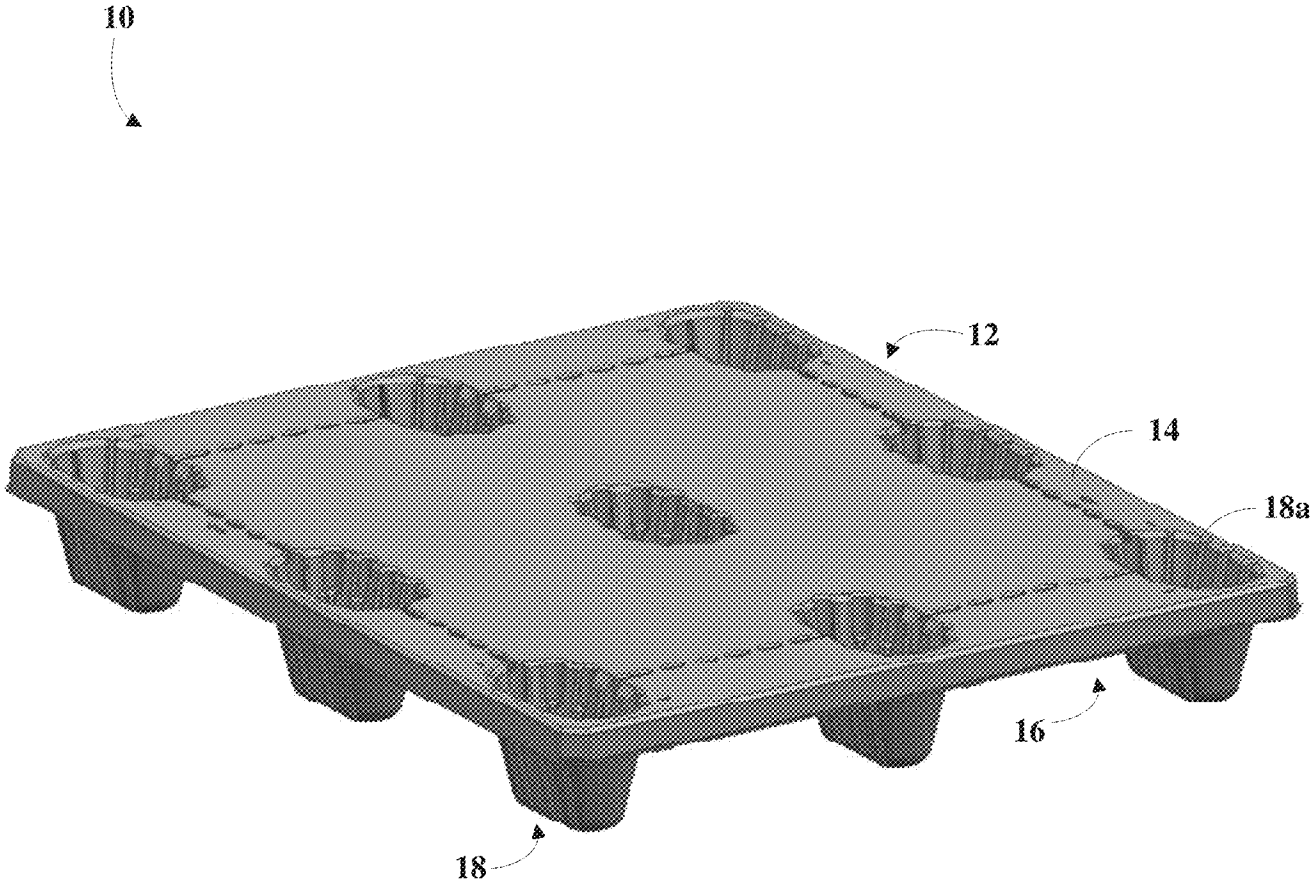
FIG. 1 generally illustrates a perspective view of a pallet according to the principles of the present disclosure.

Turning now to the drawings, FIG. 1 generally illustrates in perspective a pallet 10. The pallet 10 is preferably a twin-sheet thermoformed plastic article but may be made of other suitable materials, such as metal, heavy duty paperboard, a composite material, or a combination thereof. The pallet 10 comprises a generally square or rectangular loading platform having a width within a range of 30 to 52 inches and a length within a range of 30 to 52 inches. In some embodiments, the pallet 10 preferably includes a profile having a 40×48 inch dimension. While limited examples are described herein, the pallet 10 may comprise any suitable dimensions. The pallet 10 includes a body 12 having a top surface 14 defining the load platform and a bottom pallet surface 16. The pallet 10 has nine tapered feet 18.

The feet 18 may be formed using conventional forming or molding techniques including thermoforming. For example, the feet 18 may be molded such that the feet 18 are drawn downwardly from a general plane of the body 12. The feet 18 are preferably hollow and create nine recesses 18*a* in the top surface 14 of the body 12. The recesses 18*a* are configured to allow pallets to be nested for storage and/or shipping of the pallets. For example, a recess 18*a* associated with a first pallet 10 receives the feet 18 associated with a second similar pallet 10.

The feet 18 are preferably arranged to provide entry points for a forklift to engage the pallet 10 from all four sides; i.e., as generally illustrated in FIG. 1, the feet 18 are arranged to provide a four-way forklift entry (e.g., four channels or pathways between respective feet 18 where a fork blade associated with the forklift enters and engages the pallet 10).

Figure 2:
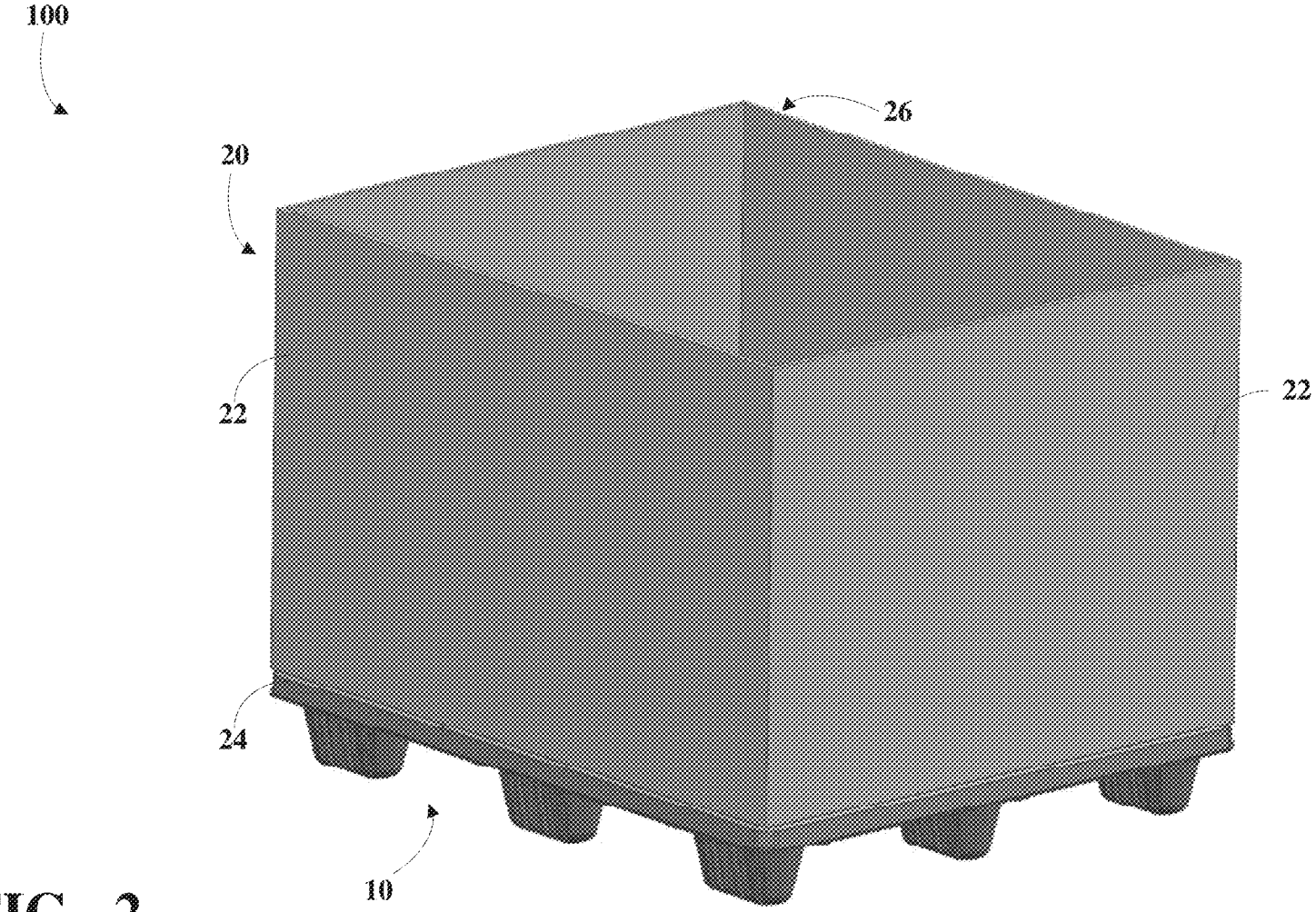
FIG. 2 illustrates a perspective view of a container including a pallet and a rectangular sleeve according to the principles of the present disclosure.

FIG. 2 generally illustrates a perspective view of a container 100 including the pallet 10, and a sleeve 20 according to the principles of the present disclosure. The container 100 may comprise a shipping a storage container as described above. The container 100 may be used in a variety of applications. For example, the container 100 may be used to ship and/or store parcels, letters, shipping materials, garbage, other suitable items, or a combination thereof. The sleeve 20 may comprise: corrugated, heavy duty paperboard; plastic; sheet metal; other suitable material; or a combination thereof. Corrugated paperboard is most typical.

The sleeve 20 has four sides 22 dimensioned to fit into a channel immediately inside the edge portion of the pallet 10. For example, the pallet 10 preferably includes a peripheral load groove extending an entire perimeter of the pallet 10. The peripheral load groove retains a portion of the sleeve 20 in place; such that, the sleeve 20 maintains a shape corresponding to the shape of the pallet 10 (e.g., square). Additionally, or alternatively, the sleeve 20 is rigidly held or retained by the peripheral load groove of the pallet 10, such that, the sleeve 20 remains rigid when received in the peripheral load groove.

Figure 3:
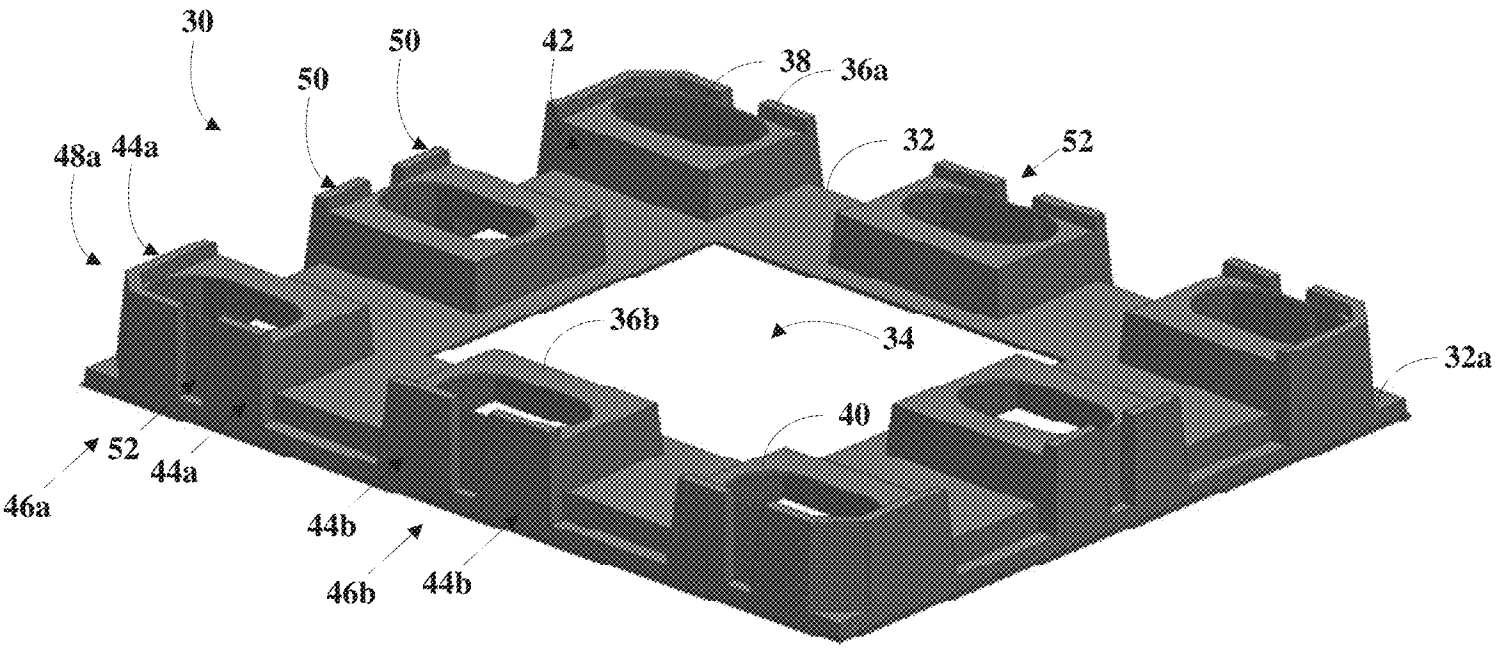
FIG. 3 generally illustrates a perspective view of a pallet stacker according to the principles of the present disclosure.

FIG. 3 generally illustrates a perspective view of a molded plastic stacker 30 according to the principles of the present disclosure. The pallet stacker 30 has a generally square or rectangular profile corresponding to that of the sleeve so as to fit into the top edge of the sleeve or onto another other top member and to close the container.

Figure 4:
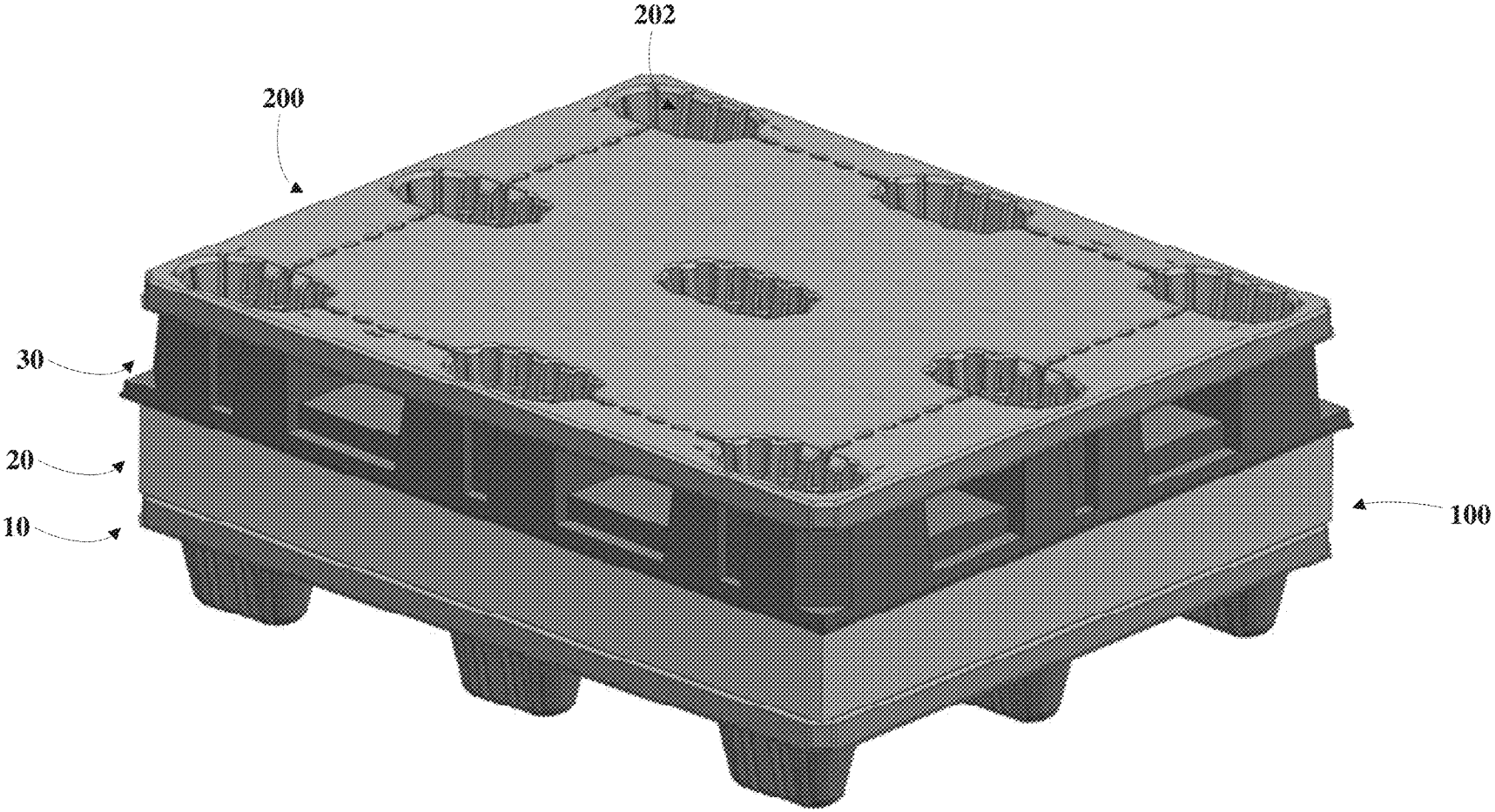
FIG. 4 generally illustrates a perspective view of a pallet stacked on top of the pallet stacker shown in FIG. 4.

When placed on top of the container, the pallet stacker 30 allows another container to be stacked onto the container 100 and provides stability to the stack in that the fit between the legs of the upper pallet and the stacker prevent lateral movement. FIG. 4 illustrates a stacked container including the container 100, which includes the pallet 10, the sleeve 20, and the pallet stacker 30 and a pallet 200 associated with a container to be stacked onto the container 100, shown here shortened vertically. For example, as is generally illustrated in FIG. 4, the pallet stacker 30 receives and retains the feet 202 of pallet 200. It is to be understood that the upper pallet 200 represents only a part of a second container stacked on top of the lower container 100; i.e., another sleeve is fit into pallet 200 and the resulting container is loaded with content just as container 100 was loaded. The weight associated with the container 200 is directed at least substantially downward along the sides 22 of the sleeve 20 of the container 100 to the floor. In some embodiments, the pallet 200 provides a lateral and/or boom strength for the pallet stacker 30 when the pallet 200 is received by the pallet stacker 30. For example, the pallet 200 (e.g., the pallet stacked onto the container 100) works in conjunction with the pallet stacker 30 to provide strength and rigidity to the pallet stacker 30, container 100, the pallet 200, a container associated with the pallet 200, or a combination thereof. In such embodiments, the pallet stacker 30 comprises less material than a pallet stacker that provides lateral and/or boom strength.

The pallet stacker 30 includes a quadrilateral frame 32. The frame 32 extends around the entire perimeter of the pallet stacker 30. The frame 32 preferably comprises one or more cut away portions 34. In some embodiments, the frame 32 may comprise a single continuous surface. The cut away portions 34 reduce material necessary to manufacture the pallet stacker 30 while the remaining material of the frame 32 provides a rigid member that supports the pallet stacker 30.

The pallet stacker 30 has a peripheral skirt that allows it to fit over the container 100. For example, the pallet stacker 30 is preferably attachable to or configured to receive the sleeve 20 within the skirt 32*a*. In this embodiment, the ledge or skirt 32*a* is disposed at or near a side edge of the frame 32 and extends around the entire perimeter of the frame 32. The skirt 32*a* preferably extends downward away from a top of the frame 32. In some embodiments, the skirt 32*a* extends 4 inches downward away from the top of the frame 32. It should be understood that the skirt 32*a* may extend less than 4 inches or more than 4 inches. The skirt 32*a* receives and surrounds a portion of the sleeve 20, such as a top edge of each of the sides 22. The skirt 32*a* provides an engagement point for attaching or placing the pallet stacker 30 onto the sleeve 20. When the pallet stacker 30 is attached to or placed onto the sleeve 20, the skirt 32*a* holds or retains each of the sides 22. The pallet stacker 30 increases and/or maintains the rigidity of the sleeve 20.

The pallet stacker 30 includes one or more boots 36*a* and 36*b*. The pallet stacker 30 shown in FIG. 3 includes 8 boots 36. Four boots 36*a* are disposed at respective corners of the pallet stacker 30 and four boots 36*b* are disposed between respective boots 36*a* and a fifth boot 36*b* disposed at or near a center point of the pallet stacker 30, if the stacker has a solid frame with no center cutaway. As is generally illustrated in FIG. 3, the pallet stacker 30 preferably includes 8 boots; i.e., the pallet stacker 30 includes four boots 36*a* disposed at respective corners of the pallet stacker 30 and four boots 36*b* disposed between respective boots 36*a* and omits the fifth boot 36*b*.

Each of the boots 36 is configured to receive a respective foot 202 of the upper pallet 200 when the pallet 200 is stacked onto the container 100. For example, each boot 36 includes an aperture or receptacle 38 defined by a top surface 40 of a respective boot 36. A receptacle 38 includes an interior profile corresponding to an exterior profile of respective foot 202 of the pallet 200. For example, each of the receptacles 38 includes an oval interior profile corresponding to an oval exterior profile of a respective foot 202 of the pallet 200.

In some embodiments, the boots 36 and corresponding receptacles 38 preferably provide a keyed fit for respective feet 202. For example, a foot 202 includes a tapered profile and is only capable of entering a receptacle 38 from a top side of a corresponding boot 36. Additionally, or alternatively, the interior profile of a receptacle 38 is configured to provide a snug fit around the exterior profile of a respective foot 202, such that, the foot 202 fits tight within a respective boot 36 (e.g., reducing and/or removing any slop, play, or undesirable movement of the foot 202 within the boot 36). By providing the keyed fit, the pallet stacker 30, among other things, supports the container stacked onto the container 100 and prevents the container from sliding off of and/or moving laterally relative to the container 100 (e.g., by holding or retaining the feet 202 in the boots 36).

Figure 5A:
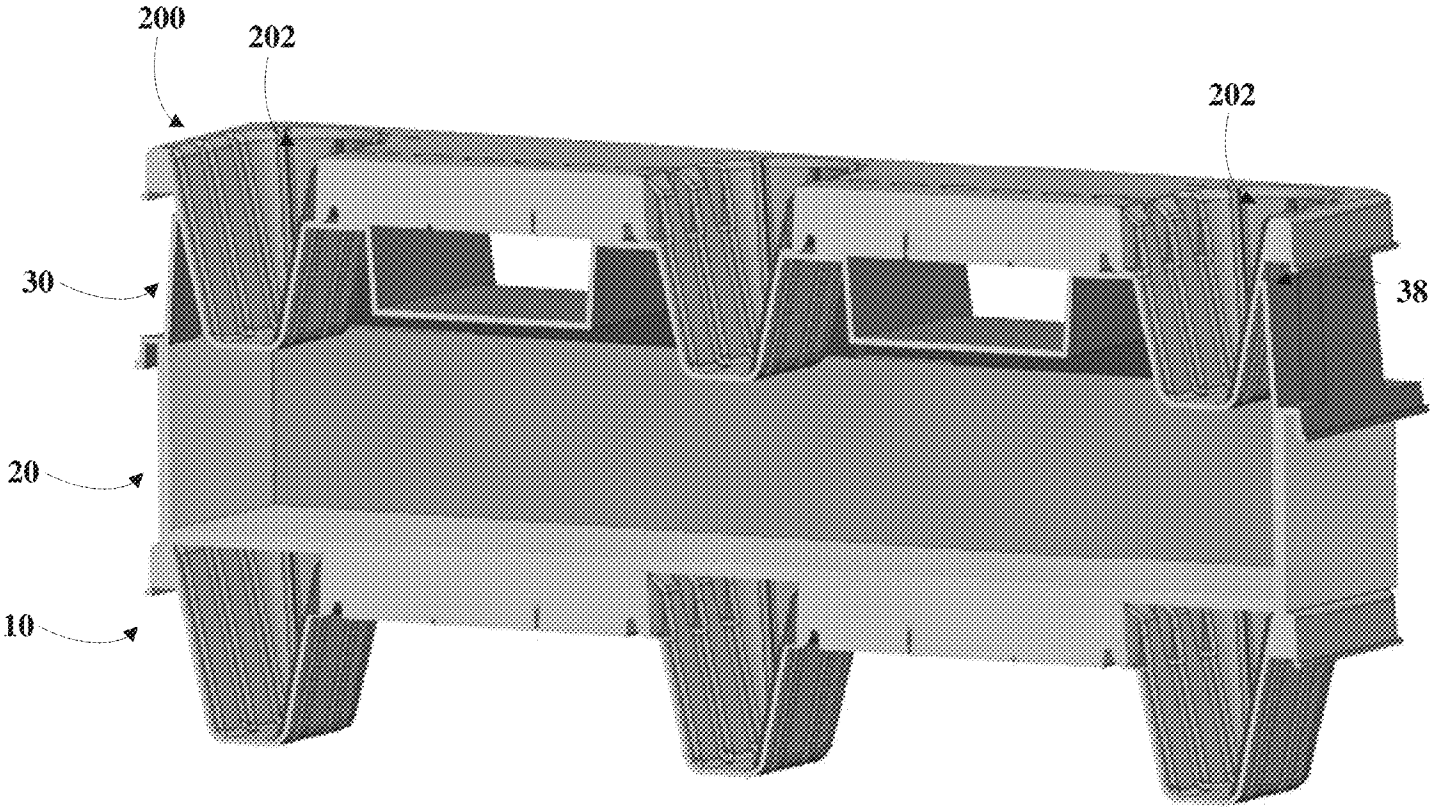
FIG. 5A generally illustrate a cutaway view of the stacked arrangement illustrated in FIG. 4.
Figure 5B:
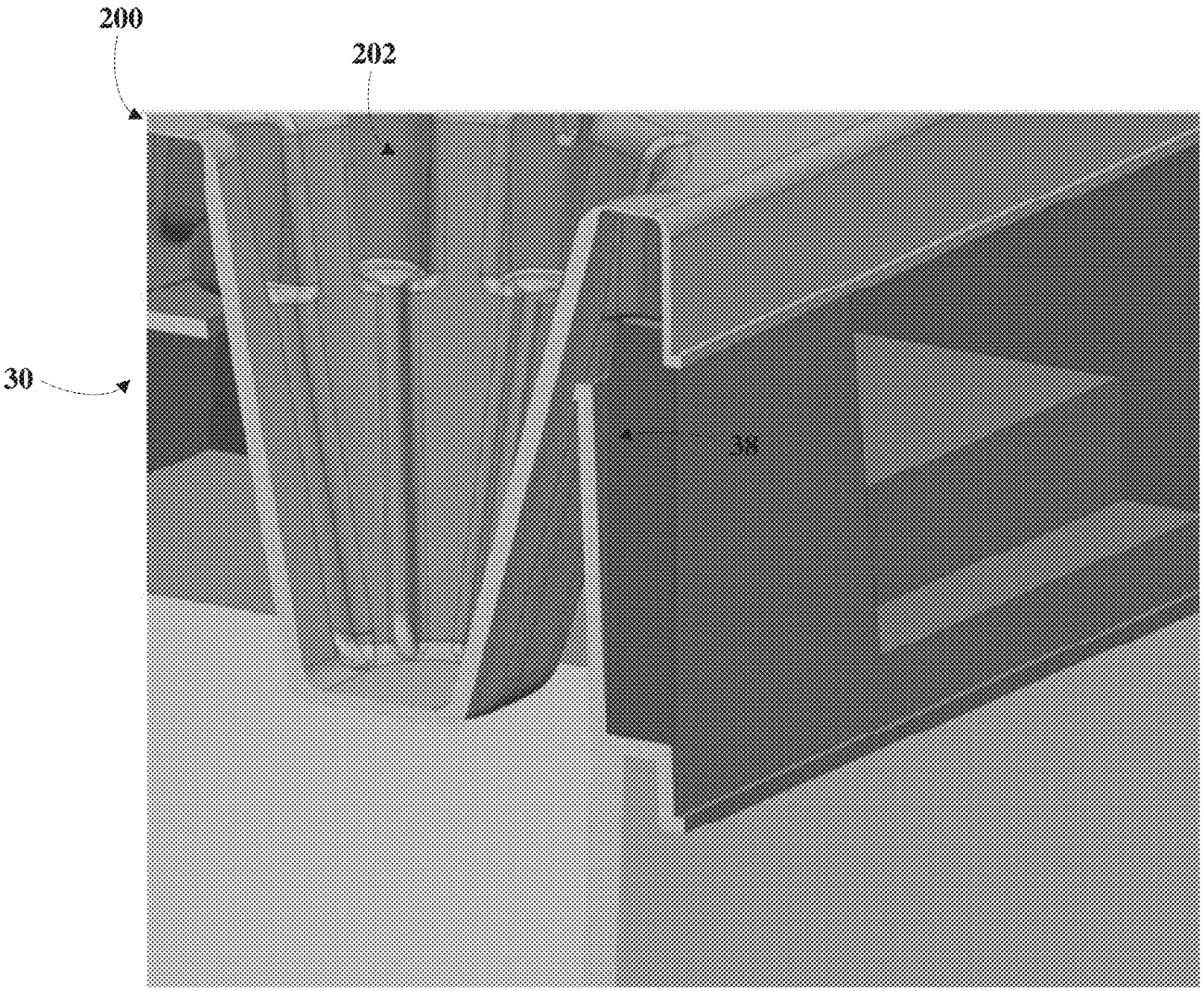
FIG. 5B shows detail of the fit between an upper pallet leg and the stacker of FIG. 3.

Each of the boots 36 include a plurality raised peripheral of walls 42 surrounding the receptacles. Each wall 42 extends upward from the frame 32 to the top surface 40 of a respective boot 36 and defines a height of a respective boot 36. The walls 42 raise a respective top surface 40 of a boot 36 above the surface of the frame 32, such that, when a receptacle 38 receives a foot 202 from the pallet 200, the foot 202 passes through the receptacle 38 but does not travel beyond the surface of the frame 32. FIGS. 5A and 5B generally illustrate a perspective cutaway view of a stacked container which illustrates a foot 202 passing through a receptacle 38.

Each of the boots 36*a* includes one or more weight distribution walls 44*a*. For example, a boot 36*a* includes a first weight distribution wall 44*a* that extends from a first side 46*a* of the boot 36*a* to a second side 48*a* of the boot 36*a* and a second weight distribution wall 44*a* disposed on a portion of the first side 46*a* of the boot 36*a*. Similarly, each of the boots 36*b* includes one or more weight distribution walls 44*b*. For example, a boot 36*b* includes a first weight distribution wall 44*b* disposed on a first portion of a first side 46*b* of the boot 36*b* and a second weight distribution wall 44*b* disposed on a second portion of the first side 46*b* of the boot 36*b*.

Each of the weight distribution walls 44*a* and 44*b* (herein after referred to as weight distribution walls 44) extend upward from a surface of the frame 32 beyond the top surface 40 of a respective boot 36. For example, the weight distribution walls 44 preferably extend from a surface of the lip 32*a*. Each of the weight distribution walls 44 engages a portion of the pallet 200. For example, each of the weight distribution walls 44 includes a top portion 50. Each top portion 50 is preferably disposed at a top of a respective weight distribution wall 44 at a relatively higher position than the top surface 40 of a respective boot 36.

A top portion 50 engages a bottom portion of the pallet 200 when the pallet 200 is stacked onto the container 100. In this manner, the top portions 50 bear all or substantially all of a weight associated with the container stacked onto the container 100. The top portions 50 transfer the weight of the container stacked onto the container 100 to a recess 52 disposed between respective weight distribution walls 44 of a respective boot 36. Each of the weight distribution walls 44 is aligned or substantially aligned with a respective side 22 of the sleeve 20 when the pallet stacker 30 is attached to or placed on the sleeve 20. In some embodiments, each of the weight distribution walls 44 is off-set from a respective side 22 of the sleeve 20.

Figure 6:
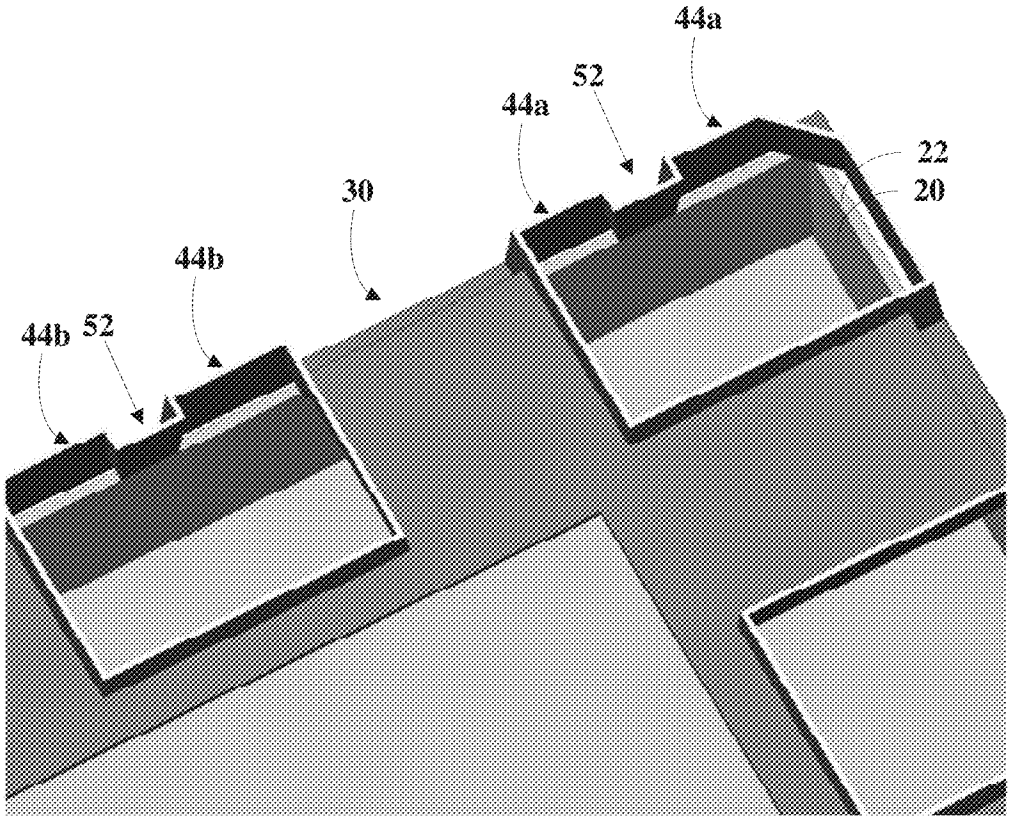
FIG. 6 generally illustrates a perspective cutaway view of a pallet stacker according to the principles of the present disclosure.

As is generally illustrated in FIG. 6, each of the recesses 52 is preferably off-set from respective weight distribution walls 44, such that, each of the recesses 52 aligns or substantially aligns with a respective side 22 of the sleeve 20 and engages a portion of the respective sides 22 when the pallet stacker 30 is attached to or placed on the sleeve 20. The weight distribution walls 44 and/or the recesses 52 transfer the weight of the container stacked onto the container 100 to the sides 22 of the sleeve 20 by engaging at least a portion of respective sides 22 and distributing a force associated with the weight downward along each side 22.

In some embodiments, the pallet stacker 30 includes four boots 36*a* disposed at respective corners of the pallet stacker 30 and may omit boots 36*b*. The boots 36*a* receive respective feet 202 of the pallet 200 and, as described above, distribute weight to portions of the sides 22 of the sleeve 20. For example, when the pallet stacker 30 includes four boots 36*a* disposed at respective corners of the pallet stacker 30, the boots 36*a* distribute and/or transfer the weight of the container stacked on the container 100 to corners of the sleeve 20 formed by two respective sides 22.

In some embodiments, the pallet stacker 30 includes four boots 36*b* disposed between respective corners of the pallet stacker 30 and may omit boots 36*a*. The boots 36*b* receive respective feet 202 of the pallet 200 and, as described above, distribute weight to portions of the sides 22 of the sleeve 20. For example, when the pallet stacker 30 includes four boots 36*b* disposed between respective corners of the pallet stacker 30, the boots 36*b* distribute and/or transfer the weight of the container stacked on the container 200 to at or near a center portion of a respective side 22 of the sleeve 20.

While only a one container stacked onto another container is described herein, the principle of the present disclosure applies to any suitable number of stacked containers including any suitable number of pallet stackers 30. Additionally, or alternatively, while limited examples are described herein, the pallet stacker 30 may include any number and/or combination of boots 36*a* and 36*b*.

While the components of a container (e.g., the pallet 10, the sleeve 20, and the pallet stacker 30) are described herein as including a generally square or rectangular profile, the components of the container may include any suitable profile. Additionally, or alternatively, the components of the container may include other dimensions that those generally illustrated and/or described herein.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Further, for simplicity of explanation, although the figures and descriptions herein may include sequences or series of steps or stages, elements of the methods disclosed herein may occur in various orders or concurrently. Additionally, elements of the methods disclosed herein may occur with other elements not explicitly presented and described herein. Furthermore, not all elements of the methods described herein may be required to implement a method in accordance with this disclosure. Although aspects, features, and elements are described herein in particular combinations, each aspect, feature, or element may be used independently or in various combinations with or without other aspects, features, and elements.

In summary, the stacking device of the present invention provides a transition piece between stacked containers of the type having a pallet-style bottom component. The stacker fits into the top of one of the container and receives one pallet leg of another container thereon. Boots formed integrally of the stacker provide receptacles for the tapered pallet legs, prevent sideways movement and transfer of the load of the upper container or containers out to the sides of the containers where the greatest vertical load strength is found.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed:

1. A transition component for stacking a pallet-based container on the top edge of an uncovered sleeve in a similar container comprising:

a single sheet plastic molding including a rectangular deck having a top surface and a peripheral skirt extending fully surround said deck surface and depending downwardly therefrom to surroundingly receive the top edge of an open, uncovered rectangular sleeve forming part of a pallet-based container;

a plurality of generally rectangular boots integrally formed with the deck wherein each boot is located at one of the four corners of the deck corresponding to the locations of tapered legs of a pallet base for a container fitting said component;

each boot including four upstanding walls having outside and inside wall portions that together fully surround a top boot surface raised above said deck surface and having therein an aperture forming a receptacle the shape of which corresponds to the shape of a leg in said pallet base; and the outside walls of each of said four boots further having an extension above the level of said top boot surface acting as weight receiving elements;

whereby the transition component may be placed on the top edge of an open, uncovered container sleeve and the pallet of another similar container stacked in stable condition on top of said transition component.

2. A transition component as described in claim 1 further including four additional boots disposed between the four corner boots, each additional boot also having top boot surfaces above said deck surface with an aperture forming a receptacle for additional intermediate pallet legs.

* * * * *